US009022819B2

(12) United States Patent
Lio et al.

(10) Patent No.: US 9,022,819 B2
(45) Date of Patent: May 5, 2015

(54) CRIMP TERMINAL

(71) Applicant: Sumitomo Wiring Systems, Ltd., Yokkaichi, Mie (JP)

(72) Inventors: Kiyokazu Lio, Yokkaichi (JP); Hong Xu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/804,120

(22) Filed: Mar. 14, 2013

(65) Prior Publication Data

US 2013/0330987 A1 Dec. 12, 2013

(30) Foreign Application Priority Data

Jun. 7, 2012 (JP) ..... 2012-129881

(51) Int. Cl.

| | |
|---|---|
| ***H01R 13/213*** | (2006.01) |
| ***H01R 4/18*** | (2006.01) |
| ***H01R 4/72*** | (2006.01) |
| *H01R 11/12* | (2006.01) |

(52) U.S. Cl.

CPC ..... *H01R 4/182* (2013.01); *H01R 4/188* (2013.01); *H01R 4/72* (2013.01); *H01R 11/12* (2013.01); *H01R 13/213* (2013.01)

(58) Field of Classification Search

USPC ..... 439/878, 885, 877, 867, 839, 843; 174/74 R; 29/859

See application file for complete search history.

(56) References Cited

U.S. PATENT DOCUMENTS

| | | | | |
|---|---|---|---|---|
| 6,206,727 | B1 * | 3/2001 | Aoyama et al. | 439/585 |
| 6,468,116 | B2 * | 10/2002 | Koide | 439/867 |
| 7,094,114 | B2 * | 8/2006 | Kurimoto | 439/839 |
| 7,252,564 | B1 * | 8/2007 | Morello et al. | 439/877 |
| 7,867,027 | B2 * | 1/2011 | Sakaguchi et al. | 439/585 |
| 2001/0016460 | A1 * | 8/2001 | Koide | 439/877 |
| 2013/0175088 | A1 * | 7/2013 | Itou et al. | 174/74 R |
| 2013/0330987 | A1 * | 12/2013 | Iio et al. | 439/878 |

FOREIGN PATENT DOCUMENTS

| | | |
|---|---|---|
| JP | 5-8871 | 2/1993 |
| JP | 5-31130 | 4/1993 |
| JP | 5-31131 | 4/1993 |
| JP | 10-289745 | 10/1998 |
| JP | 2000-182688 | 6/2000 |
| JP | 2008-176970 | 7/2008 |
| JP | 2009-230998 | 10/2009 |

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A crimp terminal (10) has a connecting portion (12) that is conductively connected to an electrical connection target, a crimp portion (14) that is fixed by crimping to a core (52) of a coated wire (50), and a link (16) extending between the connecting portion (12) and the crimp portion (14). Positioning protrusions (44) protrude out from both lateral sides of the link (16) in a width direction orthogonal to an extension direction of the link (16).

9 Claims, 3 Drawing Sheets

CRIMP TERMINAL

BACKGROUND OF THE INVENTION

1. Field of the Invention

The invention relates to a crimp terminal that is attached by crimping to an exposed core at the end of a coated wire.

2. Description of the Related Art

Crimp terminals have been employed widely with coated wires in the electrical systems of cars and the like and are attached by being crimped to an exposed core at the terminal of the coated wire. JP 5-31130A discloses one such crimp terminal that has a connecting portion, a crimp portion and a link extending therebetween. The connection portion has a conductive member, such as a metal, that is connected conductively to an electrical connection target. The crimp portion has a core crimping portion that is fixed by crimping to an outer peripheral surface of the core of the coated wire. The section of the crimp terminal attached to the coated wire often should be waterproof. Thus, a covering cylindrical body may be mounted over a peripheral region that includes the crimp portion. The covering cylindrical body may be a heat shrinkable tube containing hot-melt adhesive. The tube may be mounted over a peripheral region that includes the crimp portion. Heat then is applied to shrink the tube and to melt the adhesive. Alternatively, a peripheral region of the crimp portion may be sealed by a cylindrical molded component made of a synthetic resin.

The core must contact the crimp portion over a sufficient area to ensure reliable conduction between the crimp terminal and the core. Also, the covering cylindrical body must reliably cover the crimp portion and the core to ensure waterproofness of the crimp portion. Accordingly, JP 5-31130A proposes forming a large notch in a central section of the link between the connecting portion and the crimp portion, and an upstanding protuberance is formed by bending up the notched section on the side on which the crimp portion protrudes. The core is inserted into the crimp portion until the core abuts the upstanding protuberance, thereby ensuring sufficient contact points between the crimp portion and the core of the coated wire. Also, the covering cylindrical body is moved to a position beyond the upstanding protuberance so that the crimp portion and the core can be covered reliably with the covering cylindrical body. The engagement of the upstanding protuberance and the covering cylindrical body prevents the covering cylindrical body from coming loose and sliding back to expose the core to the outside due to vibrations, heat during vehicle installation, and the like.

An external force caused by vibrations or interference with other members will concentrate on the link between the connecting portion, which is the fixing point to the connection target, and the crimp portion, which is the fixing point to the coated wire. These external forces may apply a large bending force to the link. However, a large notch is provided in the link to form the upstanding protuberance. As a result, the connecting portion and the crimp portion are connected merely by edges of the link. Hence, the link may not have sufficient rigidity, thereby leading to problems, such as durability deterioration and breakage of the link.

Several crimp terminals may have to be stacked on a single terminal bolt. However, the upstanding protuberances and the crimping portions protrude on the same side and will interfere with one another in the stacking direction when the crimp terminals are stacked on a terminal bolt. Hence, the number of electrical wires with attached crimp terminals that can be mounted on a single terminal bolt has been restricted.

The invention was made in view of the preceding circumstances, and an object of thereof is to ease positioning a core and a covering cylindrical body on a crimp terminal, to prevent a position shift of the covering cylindrical body and to ensure rigidity of a link and to improve mounting flexibility on a terminal bolt.

SUMMARY OF THE INVENTION

The invention relates to a crimp terminal with a connecting portion, a crimping portion and a link between the connecting portion and the crimping potion. The crimping portion can be connected conductively to an electrical connection target. The crimping portion has a core crimping portion that is fixed by crimping to a core of a coated wire. Positioning protrusions protrude out in a width direction orthogonal to an extension direction of the link.

The positioning protrusions are provided on edge portions on both sides of the link and protrude out in the width direction of the link. Accordingly, the positioning protrusions engage a covering cylindrical body that is mounted over the outside of the crimp portion of the crimp terminal to prevent shifting of the covering cylindrical body. Also, the core and a covering cylindrical body such as a heat shrinkable tube can be positioned easily by positioning the core on the crimp portion side of the positioning protrusions and positioning the end portion of the covering cylindrical body on the connecting portion side beyond the positioning protrusions in the extension direction of the link. Moreover, the positioning protrusion in the crimp terminal juts out laterally from opposite edges of the link, and there is no need for a large notch in the link of the crimp terminal. Accordingly, the protrusions do not affect rigidity of the link on which stress is concentrated during use.

Moreover, the laterally extending positioning protrusions do not affect the stacking direction even when plural crimp terminals are stacked on a single terminal bolt and even when the positioning protrusions overlap, thereby improving the degree of mounting flexibility on a single terminal bolt.

Only one positioning protrusion need be provided on each edge, however, plural positioning protrusions may be provided on an edge on each side. The positioning protrusions on edges on both sides desirably are provided in opposing positions in the extension direction of the link to prevent a position shift of a covering cylindrical body, such as a heat shrinkable tube.

The positioning protrusions can any of several optional shapes, such as rectangular, circular, polygonal, or the like.

With the conventional structure described in JP 5-31130A, the core and the covering cylindrical body are positioned on both sides of an upstanding protuberance provided by cutting and bending the link. Thus, the thickness of the upstanding protuberance is the same as the plate thickness dimension of the link, and there is a risk of not being able to ensure sufficient coverage by the covering cylindrical body with respect to the core. Accordingly, the positioning protrusions of the invention preferably extend at a length dimension in the extension direction of the link that is greater than a plate thickness dimension of the link. As a result, the core can be covered by the covering cylindrical body with sufficiently large coverage compared to the conventional structure, thereby enabling improved waterproofing. Note that the length dimension of the positioning protrusions in the extension direction of the link need only be greater than the plate thickness dimension of the link, and can be set as appropriate with consideration to the required waterproofing performance, use environment or the like.

The positioning protrusions in the crimp terminal preferably have a rectangular shape in plan view. Thus, a firm engagement with a covering cylindrical body, such as a heat shrinkable tube, can be achieved using corners of the positioning protrusions, and position shift of the covering cylindrical body can be prevented through the engagement with the corners of the positioning protrusions even when the covering cylindrical body comes loose due to a hot environment during use.

The link of the crimp terminal preferably has a reinforcing ridge in a central section in the width direction, and the positioning protrusions are between the connecting portion side and the reinforcing ridge. The reinforcing ridge provides further reinforcement of the link. Also, the disposition of the positioning protrusions eases positioning the core and the covering cylindrical body. Thus, sufficient coverage of the core by the heat shrinkable tube can be ensured by positioning the core with the reinforcing ridge provided on the near side (crimp portion side) of the positioning protrusions as a marker, and by positioning the end portion of the covering cylindrical body at a position on the connecting portion side beyond the positioning protrusions that are separated from the reinforcing ridge. Note that the reinforcing ridge includes both a portion forming a ridge on the upper surface side of the linking portion (side on which the core crimping portions protrude) and a portion forming a ridge on the lower surface side.

Positioning protrusions protrude out in the width direction of the link on edges on both sides of the link of the crimp terminal. Thus, a position shift of the covering cylindrical body can be prevented through the engagement of the positioning protrusions and the inner surface of the covering cylindrical body, and the core and the covering cylindrical body can be positioned easily using the positioning protrusions. Moreover, a large notch in the link of the crimp terminal, such as with the conventional structure, is avoided. Therefore, the positioning protrusions do not adversely affect the rigidity of the link. Furthermore, a plurality of crimp terminals can be stacked on a single terminal bolt even in a state where the positioning protrusions overlap.

DETAILED DESCRIPTION OF THE PREFERRED EMBODIMENTS

Figure 1:
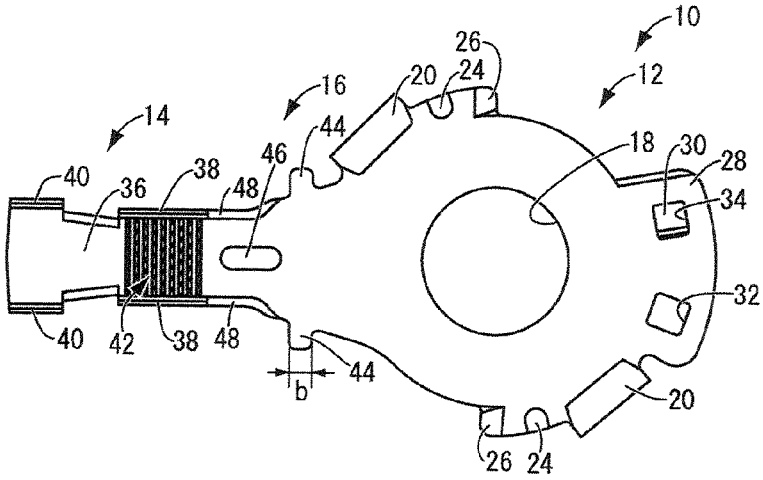
FIG. 1 is a plan view of a crimp terminal of an embodiment of the invention.
Figure 2:
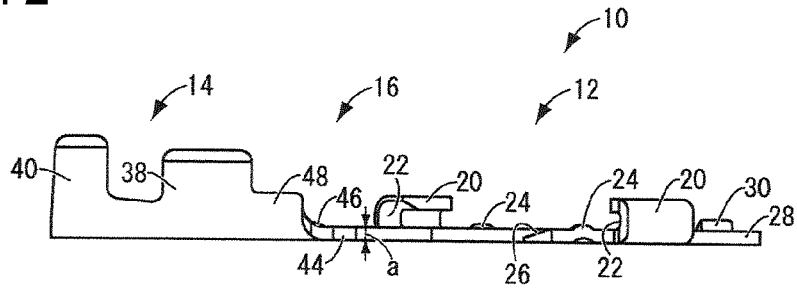
FIG. 2 is a side view of the crimp terminal of FIG. 1.

A crimp terminal in accordance with the invention is identified by the numeral 10 in FIGS. 1 to 5. The crimp terminal 10 is formed unitarily to include a connecting portion 12 that is to be connected electrically conductively to a connection target, a crimp portion 14 having core crimping portions 38 that are to be fixed by crimping to a core 52 of a coated wire 50, and a link 16 extending therebetween.

The crimp terminal 10 is formed from a conductive metal, such as brass, copper, copper alloy, aluminum and aluminum alloy, that is capable of undergoing processing, such as pressing and punching. The crimp terminal 10 is of approximately uniform thickness throughout.

Figure 3:
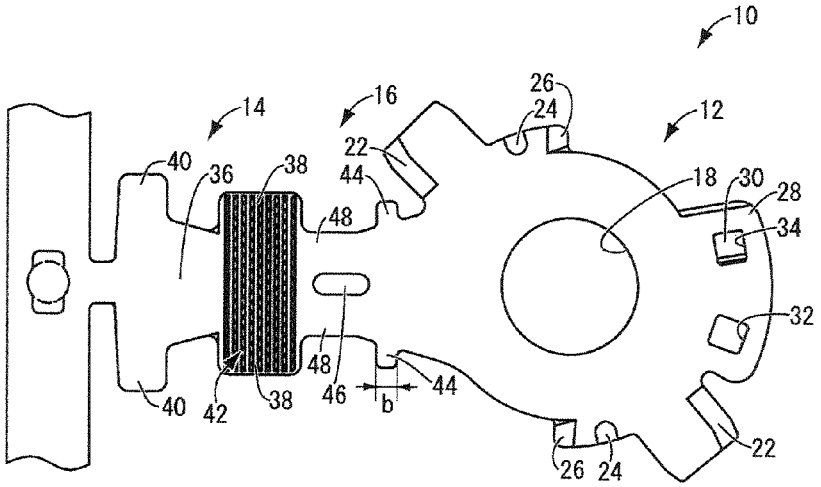
FIG. 3 is a plan view of a blank for forming the crimp terminal of FIG. 1.

The connecting portion 12 has an approximately elliptical planar shape, and a through hole 18 passes through a central section. The through hole 18 can receive a terminal bolt that is screwed into a predetermined position. Two diametrically opposed accommodating portions 20 are provided on the outer periphery of the connecting portion 12. The accommodating portions 20 are formed from approximately rectangular planar protrusions that are bent up from the plane of the connecting portion 12 to define U-shapes with accommodating grooves 22 that open in toward the center of the connecting portion 12. As shown in FIG. 3, one edge of each accommodating portion 20 is thinned to define a tapered entry to each accommodating groove 22. Protuberances 24 are provided in positions slightly separated clockwise from the respective accommodating portions 20, and tapered portions 26 are in positions slightly separated further clockwise therefrom. The tapered portions 26 have shapes corresponding to the accommodating grooves 22. A lengthened portion 28 extends out from the outer periphery of the connecting portion 12 at a position diametrically opposite the crimp portion 14 (right side in FIG. 1). An upstanding protuberance 30 and a rectangular through hole 32 are formed in the lengthened portion 28 at positions separated in the circumferential direction. The protuberance 30 is formed by making a U-shaped cut in the lengthened portion 28 and bending up a region enclosed the U-shaped cut to form a notch 34 below the protuberance 30. The protuberance 30 is offset by a dimension that is approximately the same as or less than the plate thickness of the lengthened portion 28. The protuberance 30 is slightly smaller than the through hole 32 and thus can fit in the through hole 32 of another crimp terminal 10.

The crimp portion 14 has a placement portion 36 with a long approximately rectangular planar shape. Core crimping portions 38 and coated wire crimping portions 40 are provided on opposite widthwise sides of the placement portion 36. The core crimping portions 38 and coated wire crimping portions 40 initially are approximately rectangular planar pieces that protrude from opposite sides of the placement portion 36 and then are bent up to define walls on both sides of the placement portion 36. Protuberances 42 that may be trapezoidal extend across the entire surface of the core crimping portions 38 and the region therebetween.

Positioning protrusions 44 protrude out from the link 16 in a width direction orthogonal to the extension direction of the link 16 and are between the connecting portion 12 and the crimp portion 14. Each positioning protrusion 44 has a rectangular shape in plan view, and have a dimension b (see FIG. 1) in the extension direction of the link 16 that is greater than a plate thickness dimension a (see FIG. 2) of the link 16.

The positioning protrusions 44 can be formed simply by pressing and punching, without needing a subsequent cutting and bending process such as with the conventional structure described in JP 5-31130A. Also, the positioning protrusions 44 can be in sections that otherwise would be scrap, as is clear from FIG. 3, and hence can be provided without an increase in the number of components, materials or processes.

A reinforcing ridge 46 is provided in a widthwise central section of the link 16 and projects up on the upper surface (up in FIG. 2) of the link 16 to achieve further reinforcement of the link 16. Note that the positioning protrusions 44 are provided more on the connecting portion 12 side than is the reinforcing ridge 46. Approximately rectangular planar protuberances 48 are bent up at edges of the link 16 on opposite widthwise sides of the reinforcing ridge 46. The protuberances further reinforce the link 16 and prevent the core 52 from sticking out on the link 16.

Figure 4:
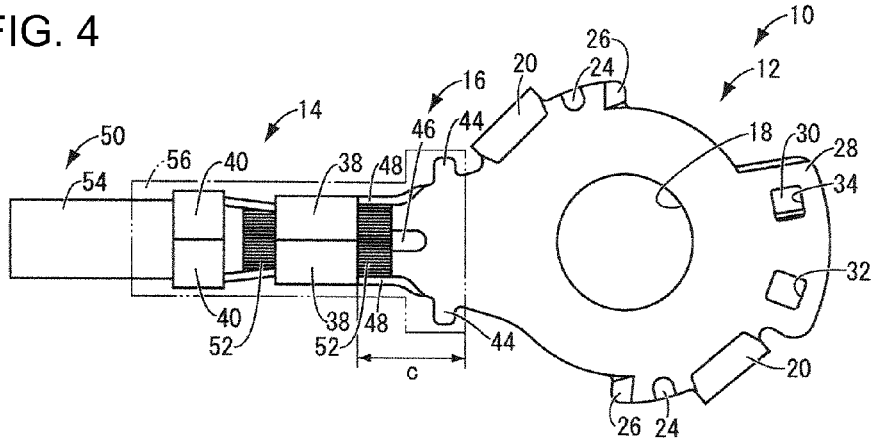
FIG. 4 is a plan view of the crimp terminal shown of FIG. 1 attached to an electrical wire and having a heat shrinkable tube thereon.

The method of crimping the coated wire 50 to the crimp terminal 10 is described with reference to FIG. 4. The coated wire 50 has the core 52 formed by bundling copper, aluminum or other metal wires to define a conductor that is covered with an insulation sheath 54 made of ethylene resin or other material having electrical insulation properties. The insulation sheath 54 adjacent the tip of the coated wire 50 is stripped to expose the core 52. A heat shrinkable tube 56 then is moved onto the outer peripheral side of the coated wire 50.

The tip section of the coated wire 50 with the exposed core 52 is placed on the upper surface of the placement portion 36 in the crimp portion 14 of the crimp terminal 10. At this point, the core 52 is positioned so that the tip portion of the core 52 is over the reinforcing ridge 46 provided on the crimp portion 14 side of the positioning protrusions 44 to reach an approximately central section in the axial direction of the reinforcing ridge 46. It is thereby possible to simply and accurately arrange the exposed core 52 between the core crimping portions 38 and to arrange a section covered with the insulation sheath 54 between the coated wire crimping portions 40.

Crimping then is performed on the core crimping portions 38 and the coated wire crimping portions 40 using a well-known crimping device, such as shown in JP 05-23389A. The core crimping portions 38 and the coated wire crimping portions 40 thereby plastically deform and wrap around the outer peripheral surface of the core 52 and the coated wire 50. The inner surface of the crimp portion 14 will abut against the outermost peripheral surface of the core 52 and the coated wire 50 in a crimped state, and the protuberances 42 on the inner surface of the core crimping portions 38 provide a large contact area with the core 52. Note that, in this state, the core 52 remains exposed.

The heat shrinkable tube 56 then is slid along the coated wire 50 until the end of the heat shrinkable tube 56 is between the positioning protrusions 44 and the connecting portion 12. The core 52 and the heat shrinkable tube 56 thereby are arranged simply and accurately. The heat shrinkable tube 56 covers the core 52 with a sufficiently large coverage c to improve the waterproof effect. In this state, the heat shrinkable tube 56 is heated using heating means such as an electric heater.

Thus, the heat shrinkable tube 56 is shrunk and a hot-melt adhesive (not shown) melted by the heat adheres a section of the core 52 from the positioning protrusions 44, the core crimping portions 38, the coated wire crimping portions 40, and a tip portion of the insulation sheath 54 due to the shrink force of the heat shrinkable tube 56. Moreover, the hot-melt adhesive melted by the heating loses viscosity and fluidizes. Thus, the space between the abovementioned members is filled completely without leaving large gaps, and the abovementioned members are adhered in a liquid-tight state.

The heat shrinkable tube 56 and the hot-melt adhesive ensure that the core 52 section of the coated wire 50 placed on the upper surface of the placement portion 36 is covered and sealed from the outside. Also, the positioning protrusions 44 give the heat shrinkable tube 56 a flattened shape that advantageously prevents the melted hot-melt from flowing onto the connecting portion 12, thereby preventing a bad connection that could be caused by the hot-melt adhesive on the connecting portion 12.

Figure 5:
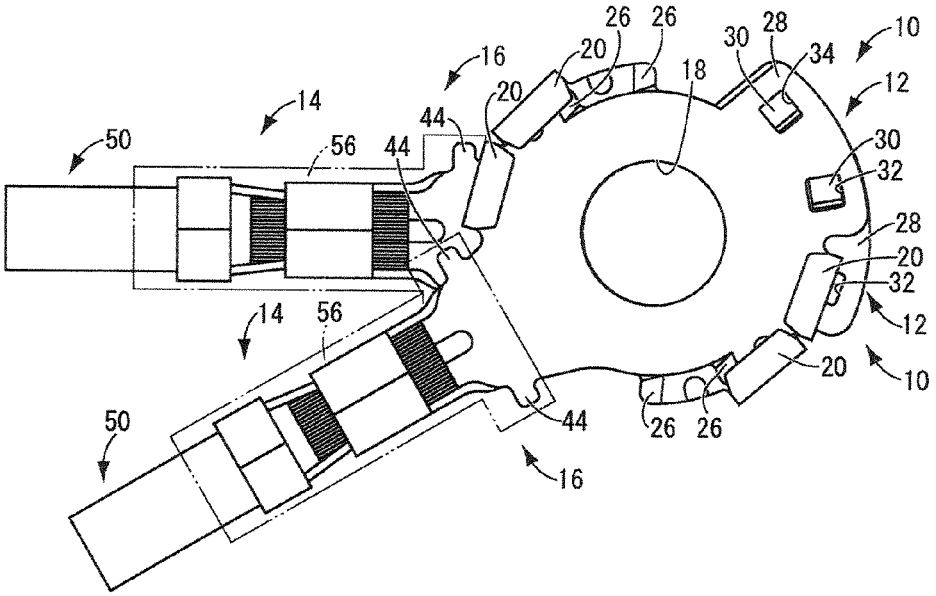
FIG. 5 is a plan view showing the crimp terminals, electrical wires and heat shrinkable tubes of FIG. 4 in a stacked array.

A plurality of the crimp terminals 10 may be stacked on a single terminal bolt by placing the crimp terminals 10 one on top of the other so that the through holes 18 thereof coincide, as shown in FIG. 5. More particularly, one crimp terminal 10 is placed on another crimp terminal 10 so that the through holes 18 coincide and so that the tapered portions 26 of the upper crimp terminal 10 are substantially adjacent and counterclockwise of the accommodating grooves 22 in the accommodating portions 20 of the lower (bottom side in FIG. 5) crimp terminal 10. The upper crimp terminal 10 then is rotated clockwise so that the tapered portions 26 of the upper crimp terminal 10 enter the accommodating grooves 22 in the accommodating portions 20 of the lower crimp terminal 10. The upstanding protuberances 30 of the lower crimp terminal 10 are pressed down resiliently upon entering the accommodating grooves 22, but return resiliently to enter and engage the through holes 32 of the upper crimp terminal 10 after sufficient rotation. The accommodating portions 20 and the upstanding protuberances 30 of the lower crimp terminal 10 position and retain the outer periphery of the upper crimp terminal 10, before the crimp terminals 10 are screwed down by the terminal bolt. Additional crimp terminals 10 can be placed thereon in a similar manner. The positioning protrusions 44 in the crimp terminal 10 jut out in the width direction from both sides of the link 16. Hence, a plurality of crimp terminals 10 can be stacked on a single terminal bolt, and the positioning protrusions 44 will not interfere in the stacking direction even if the positioning protrusions 44 of the upper and lower crimp terminals 10 overlap.

The positioning protrusions 44 protrude out in the width direction at both sides of the link 16 of the crimp terminal 10. Thus, the core 52 and a covering cylindrical body, such as the heat shrinkable tube 56, can be positioned easily, by disposing the core 52 on the crimp portion 14 side of the positioning protrusions 44 and disposing the end of the covering cylindrical body on the connecting portion 12 side beyond the positioning protrusions 44 in the extension direction of the link 16.

The laterally projecting positioning protrusions 44 cause the heat shrinkable tube 56 to assume a flattened shape when the heat shrinkable tube 56 is heat shrunk, thereby preventing an outflow of hot-melt adhesive toward the connecting portion 12. Also, the engagement of the inner surface of the heat shrinkable tube 56 with the positioning protrusions 44 prevents movement of the heat shrinkable tube 56.

A large notch is not required in the link 16 to form a positioning protrusion, as in the conventional structure. Thus, the positioning protrusions 44 can be provided while ensuring sufficient rigidity of the link 16 on which stress is concentrated during use. Moreover, the core 52 and the covering cylindrical body of the conventional structure are positioned on both sides of the upstanding protuberance that is formed by cutting and bending a notched portion. The coverage by the covering cylindrical body with respect to the core 52 is the same as the thickness of the upstanding protuberance, that is, the plate thickness dimension of the link. However with the present embodiment, the positioning protrusions 44 have a length dimension that is greater than the plate thickness dimension of the link 16, thereby enabling the core 52 to be covered by the heat shrinkable tube 56 with a larger coverage than the conventional structure for achieving an improved waterproofness. Note that the length dimension can be set as appropriate, with consideration to the required waterproofing performance, use environment or the like.

The positioning protrusions 44 are rectangular and hence have corners that achieve a firm engagement with a covering cylindrical body, such as the heat shrinkable tube 56. Thus, the heat shrinkable tube 56 will not come loose or shift when used in a hot environment. More specifically, the positioning protrusions 44 desirably have rounded corners, as shown in FIG. 4, to achieve a firm engagement without tearing of a covering cylindrical body, such as the heat shrinkable tube 56, that contact the corners of the positioning protrusions 44.

A plurality of crimp terminals 10 can be positioned and temporarily retained in a stacked array before the crimp terminals 10 are screwed down by a terminal bolt. More particularly, outer peripheral edge portions of an upper crimp terminal 10 can be fit in the accommodating grooves 22 of the accommodating portions 20 on opposite outer peripheral edges of a lower crimp terminal 10. The upstanding protuberance 30 of the lower crimp terminal 10 then engages the through hole 32 of the upper crimp terminal 10. The crimp terminals 10 are stacked by being rotated so that the cores 52 and the like do not overlap. Therefore, interference of the accommodating portions 20 in the stacking direction of the crimp terminals 10 is avoided.

The reinforcing ridge 46 provides further reinforcement of the link 16. Also, the positioning protrusions 44 are distanced further on the connecting portion 12 side than is the reinforcing ridge 46 to facilitate positioning the core 52 and the heat shrinkable tube 56 and to ensure sufficient coverage of the core 52 by the heat shrinkable tube 56. The positioning protrusions 44 is a marker for positioning the core 52 with the reinforcing ridge 46 on the crimp portion 14 side, and positioning the end of the heat shrinkable tube 56 at a position on the connecting portion 12 side beyond the positioning protrusions 44 that are separated from the reinforcing ridge 46. Further reinforcement of the link 16 is achieved by the protuberances 48 on both lateral sides of the reinforcing ridge 46. Note that the reinforcing ridge 46 may form a ridge on the lower surface side of the link 16.

An embodiment of the invention has been described above, but the invention is not limited in any way by the specific described embodiment. For example, although one positioning protrusion 44 need be provided on each side, a plurality of positioning protrusions 44 may be formed on an edge portion on each side, with the positioning protrusions desirably being provided in opposing positions of edges on both sides. Also, the shape of the positioning protrusions 44 can be varied.

The crimp portion 14 may be sealed by a cylindrical molded component made of a synthetic resin that encloses the crimp portion 14 from the outside instead of using the heat shrinkable tube 56. Effects similar to the case of the heat shrinkable tube 56, such as ease of positioning, prevention of position shift and improvement in the degree of mounting flexibility, that are realized by the crimp terminal 10 of the present invention can be enjoyed with a cylindrical molded component.

The shape of the protuberances 42 that are provided across the entire surface of the core crimping portions 38 and the region therebetween is not limited to being trapezoidal, and can be circular, polygonal, or the like. Also, the protuberances 42 need not be provided.

What is claimed is:

1. A crimp terminal comprising:

a connecting portion having a substantially planar section configured for conductive connection to an electrical connection target;

a crimp portion spaced from the connecting portion along an extension direction and configured for crimping to a core of a coated wire;

a link extending between the connecting portion and the crimp portion and including planar side regions that lie substantially in a common plane as the planar section of the connecting portion; and positioning protrusions provided on opposite sides of the link and protruding out in a width direction orthogonal to the extension direction, the positioning protrusions lying substantially in a common plane with the side regions of the link and the planar section of the connecting portion.

2. The crimp terminal of claim 1, wherein each of the positioning protrusions has a length parallel to the extension direction that is greater than a plate thickness dimension of the link.

3. The crimp terminal of claim 1, wherein the positioning protrusions are substantially rectangular in plan view.

4. The crimp terminal of claim 1, wherein the positioning protrusions have rounded corners.

5. The crimp terminal of claim 1, further comprising a reinforcing ridge in a central section of the link in the width direction.

6. The crimp terminal of claim 5, wherein a distance from the positioning protrusions to the connecting portion is less than a distance from the reinforcing ridge to the connecting portion.

7. The crimp terminal of claim 5, further comprising protuberances extending along opposite lateral sides of the link outward of the reinforcing ridge.

8. The crimp terminal of claim 1, wherein the positioning protrusions are substantially opposite one another in the width direction.

9. The crimp terminal of claim 1, further comprising a heat shrinkable tube covering the crimp portion and the link including the positioning protrusions.

* * * * *